US007164880B2

(12) United States Patent
Kim et al.

(10) Patent No.: US 7,164,880 B2
(45) Date of Patent: Jan. 16, 2007

(54) FUSING DEVICE FOR AN ELECTROPHOTOGRAPHIC IMAGE FORMING APPARATUS

(75) Inventors: Hwan-guem Kim, Seoul (KR); Durk-hyun Cho, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/625,900

(22) Filed: Jul. 24, 2003

(65) Prior Publication Data

US 2004/0141778 A1 Jul. 22, 2004

(30) Foreign Application Priority Data

Aug. 29, 2002 (KR) ..... 10-2002-0051486

(51) Int. Cl.
*G03G 15/20* (2006.01)

(52) U.S. Cl. ..... 399/330

(58) Field of Classification Search ..... 399/307, 399/330, 334; 219/216, 388, 469
See application file for complete search history.

(56) References Cited

U.S. PATENT DOCUMENTS

| | | | | |
|---|---|---|---|---|
| 4,284,875 | A * | 8/1981 | Namiki et al. | 219/216 |
| 4,378,752 | A * | 4/1983 | Knechtel | 118/60 |
| 5,426,495 | A * | 6/1995 | Sawamura et al. | 399/331 |
| 6,072,156 | A * | 6/2000 | Matsuo et al. | 219/216 |
| 6,072,979 | A * | 6/2000 | Hiroaka | 399/330 |
| 6,096,995 | A * | 8/2000 | Toyota et al. | 219/216 |
| 6,512,913 | B1 * | 1/2003 | Hirst et al. | 399/328 |
| 6,571,080 | B1 * | 5/2003 | Lee et al. | 399/330 |
| 6,580,896 | B1 * | 6/2003 | Lee | 399/330 |
| 6,628,917 | B1 * | 9/2003 | Lee | 399/330 |
| 6,665,515 | B1 * | 12/2003 | Lee | 399/330 |
| 6,853,833 | B1 * | 2/2005 | Cho et al. | 399/330 |

FOREIGN PATENT DOCUMENTS

| | | | |
|---|---|---|---|
| EP | 1217466 | A1 * | 6/2002 |
| JP | 54056448 | A * | 5/1979 |
| JP | 54092750 | A * | 7/1979 |
| JP | 59-204071 | A * | 11/1984 |
| JP | 359204071 | A | 11/1984 |
| JP | 63-075774 | | 4/1988 |
| JP | 07140828 | A * | 6/1995 |
| JP | 09166931 | A * | 6/1997 |
| JP | 09-197863 | | 7/1997 |
| KR | 20020051813 | A | 6/2002 |
| WO | WO 02/31601 | A1 * | 4/2002 |

OTHER PUBLICATIONS

Korean Office Action for Korean Application No. 10-2002-0051486.
Office Action dated May 28, 2004 for corresponding Korean Application No. 10-2002-51486.

* cited by examiner

*Primary Examiner*—Robert Beatty
(74) *Attorney, Agent, or Firm*—Staas & Halsey LLP

(57) ABSTRACT

A fusing device for an electrophotographic image forming apparatus. The fusing device includes a fusing roller with an outer rubber roller, a heating pipe, both ends of which are sealed and in which a predetermined amount of a working fluid is contained, a heater which is placed on the heat pipe, and a pressing roller which closely adheres paper passing between the pressing roller and the fusing roller to the fusing roller.

8 Claims, 6 Drawing Sheets

FUSING DEVICE FOR AN ELECTROPHOTOGRAPHIC IMAGE FORMING APPARATUS

CROSS-REFERENCE TO RELATED APPLICATIONS

This application claims the priority of Korean Patent Application No. 2002-51486, filed on Aug. 29, 2002, in the Korean Intellectual Property Office, the disclosure of which is incorporated herein in its entirety by reference.

BACKGROUND OF THE INVENTION

1. Field of the Invention

The present invention relates to a fusing device for an electrophotographic image forming apparatus, and more particularly, to a fusing device for an electrophotographic image forming apparatus having a large-sized fusing roller which supplies fusing heat to a color or high-speed laser printer.

2. Description of the Related Art

In general, an electrophotographic printer includes a fusing device which heats the paper onto which a toner image is transferred, melts the toner image in a powder state on the paper, and fuses the melted toner image on the paper. The fusing device includes a fusing roller which fuses toner onto the paper, and a pressing roller which pushes the paper against the fusing roller.

FIG. 1 is a schematic profile cross-sectional view of a conventional fusing roller using a halogen lamp as a heat source, and FIG. 2 is a schematic frontal cross-sectional view of a conventional fusing device using the fusing roller of FIG. 1. Referring to FIG. 1, a fusing roller 10 includes a cylindrical roller 11 and a halogen lamp 12 installed inside the cylindrical roller 11. A TEFLON® coating layer 11*a* is formed on a circumference of the cylindrical roller 11. The cylindrical roller 11 is heated by radiant heat generated from the halogen lamp 12.

Referring to FIG. 2, a pressing roller 13 is placed under the fusing roller 10 to be opposite to the fusing roller 10, and paper 14 is placed between the fusing roller 10 and the pressing roller 13. The pressing roller 13 is elastically supported by a spring 13*a*. The pressing roller 13 closely adheres the paper 14, which is passing between the fusing roller 10 and the pressing roller 13, to the fusing roller 10 with a predetermined pressure. In this case, the toner image 14*a*, which is formed on the paper 14 in a powder state, is fused on the paper 14 due to the predetermined pressure and heat while passing between the fusing roller 10 and the pressing roller 13.

A thermistor 15 and a thermostat 16 are installed at one side of the fusing roller 10. The thermistor 15 measures a surface temperature of the fusing roller 10, and the thermostat 16 cuts off power supplied to the halogen lamp 12 when the surface temperature of the fusing roller 10 exceeds a predetermined value. The thermistor 15 measures the surface temperature of the fusing roller 10 and transmits an electrical signal corresponding to the measured temperature to a controller (not shown) of a printer (not shown). The controller controls the power supplied to the halogen lamp 12 according to the measured temperature and maintains the surface temperature of the fusing roller 11 within a given range. When the temperature of the fusing roller 11 exceeds the predetermined set value because the controller fails in controlling the temperature of the fusing roller 11, a contact (not shown) of the thermostat 16 becomes open to cut off the supply of power to the halogen lamp 12.

Power consumption of a conventional fusing device using a halogen lamp as a heat source is large. In particular, the conventional fusing device requires a fairly long warming-up time when power is supplied to the fusing device. In particular, in the conventional fusing device, the fusing roller is heated by radiant heat generated from the heat source. Thus, the heat transfer is slow, and compensation for a difference in temperature due to a temperature decrease caused by contacting the paper is slow. It is therefore difficult to maintain the fusing roller 10 at a predetermined temperature.

Accordingly, it is difficult to apply the conventional fusing device to a printer requiring a rapid fusing heat supply, such as a color laser printer or a black-and-white laser printer for high-speed printing of 25 sheets per minute.

In addition, when the conventional fusing device having the above structure is used in a color laser printer or a high-speed laser printer, the diameter of the fusing roller should increase. In order to improve heat transfer onto paper which moves at a high-speed, or heat transfer onto paper on which a toner image is overlapped, the width of the fusing nip is needed to be increased.

SUMMARY OF THE INVENTION

The present invention provides a fusing device for an electrophotographic image forming apparatus that reduces a warming-up time using a heat pipe, and a rubber roller having a predetermined thickness is placed on the surface of a fusing roller so as to increase the width of a fusing nip.

According to one aspect of the present invention, there is provided a fusing device for an electrophotographic image forming apparatus. The device includes a fusing roller which includes a heat pipe, both ends of which are sealed and in which a predetermined amount of a working fluid is contained, a heater which is placed on the heat pipe, a rubber roller, and a pressing roller which closely adheres paper passing between the pressing roller and the fusing roller to the fusing roller.

The rubber roller may be of a predetermined thickness so as to form a fusing nip with the pressing roller, wherein the fusing nip is of a predetermined width.

Also, the rubber roller may be formed of silicon, and the thickness of the rubber roller may be 1–3 mm.

Also, the outer diameter of the fusing roller may be 35–50 mm.

Also, the rubber roller and the heater may be adhered together using a heat-resistant adhesive coated between the rubber roller and the heater.

Additional aspects and/or advantages of the invention will be set forth in part in the description which follows and, in part, will be obvious from the description, or may be learned by practice of the invention.

BRIEF DESCRIPTION OF THE DRAWINGS

These and/or other objects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
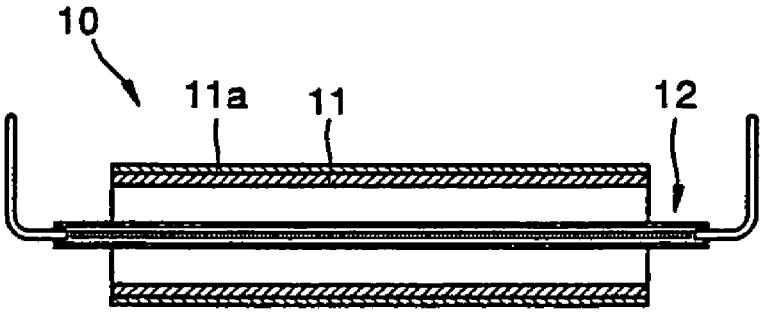
FIG. 1 (PRIOR ART)
FIG. 1 is a schematic profile cross-sectional view of a conventional fusing roller using a halogen lamp as a heat source.
Figure 2:
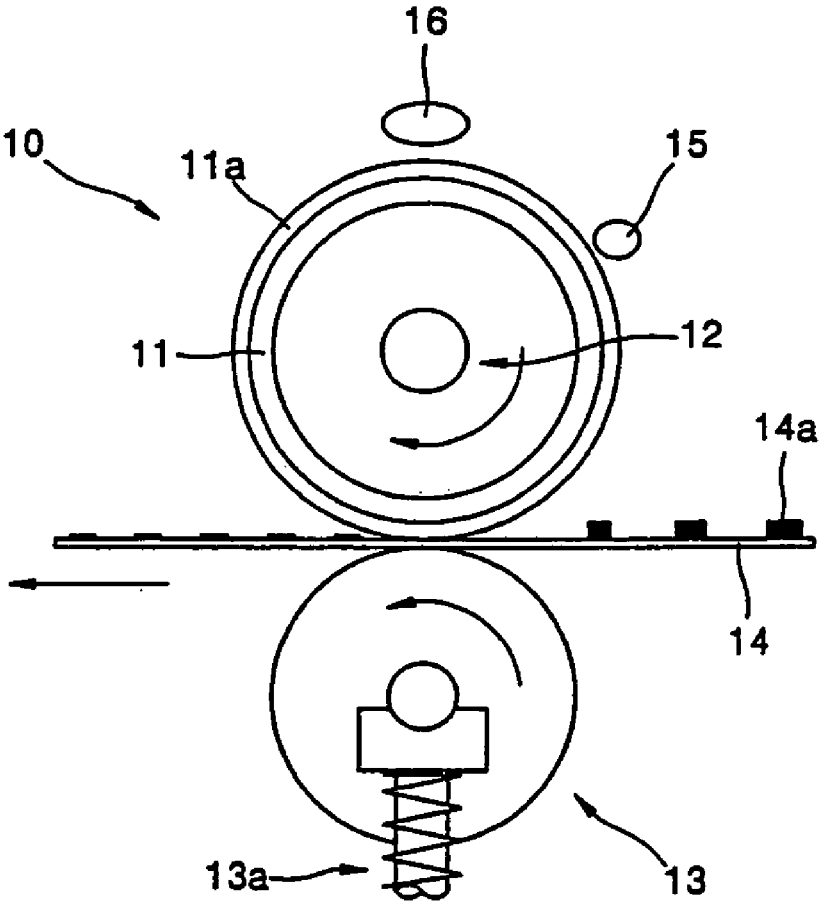
FIG. 2 (PRIOR ART)
FIG. 2 is a schematic frontal cross-sectional view of a conventional fusing device using the fusing roller of FIG. 1.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures. Thicknesses of layers or regions shown in drawings are exaggerated for clarity of a specification.

Figure 3:
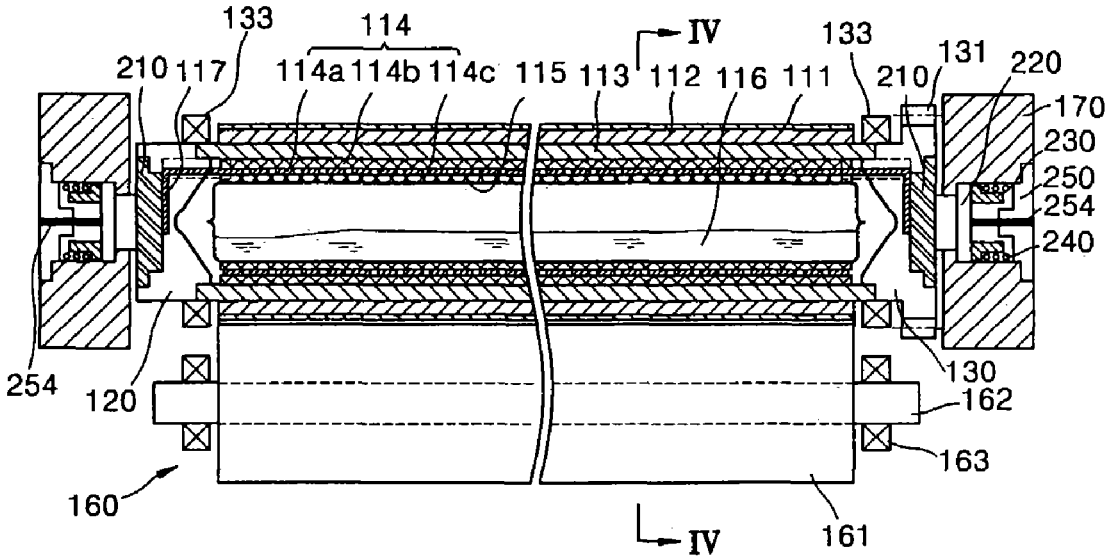
FIG. 3 is a schematic profile cross-sectional view of a fusing device for an electrophotographic image forming apparatus according to a first embodiment of the present invention.
Figure 4:
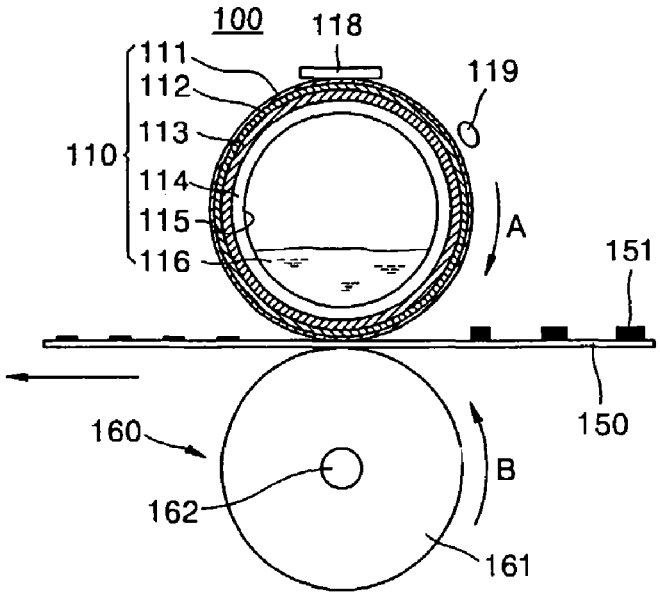
FIG. 4 is a cross-sectional view taken along line IV—IV of FIG. 3.

FIG. 3 is a schematic profile cross-sectional view of a fusing device for an electrophotographic image forming apparatus according to a first embodiment of the present invention, and FIG. 4 is a cross-sectional view taken along line IV—IV of FIG. 3. Referring to FIGS. 3 and 4, a fusing device 100 includes a fusing roller 110 having a cylindrical roller 113 which rotates in a direction in which a sheet of print paper 150 having a toner image 151 thereon is ejected, i.e., in a direction indicated by arrow A, and a pressing roller 160 which is installed to face the fusing roller 110 through the paper 150 therebetween and rotates in a direction indicated by arrow B to be in contact with the fusing roller 110.

A silicon rubber roller 112, having been formed to a predetermined thickness, for example, to a thickness of 1–3 mm, is installed on a circumference of the cylindrical roller 113. A toner protective layer 111 is formed of TEFLON® at a thickness of 20–30 μm on the silicon rubber roller 112. A heater 114 is disposed on an inner surface of the cylindrical roller 113, and a heat pipe 115, both ends of which are sealed, is disposed on an inner surface of the heater 114.

Meanwhile, a thermistor, 118 which measures a surface temperature of the fusing roller, is installed on the toner protective layer 111. Also, a thermostat 119 is installed at one side of the toner protective layer 111 and cuts off a power supplied to the heater 114 and prevents overheating when the surface temperature of the fusing roller 110 is rapidly increased.

The heater 114 includes an Ni—Cr resistive coil 114*a* which generates heat by an electricity supplied from an external power supply. Mica sheets 114*b* and 114*c*, which are insulating layers, are placed on and under the resistive coil 114*a*. The heater 114 includes a lead 117 which connects electricity to the resistive coil 114*a* formed on both ends of the heater 114. A Cr—Fe coil may be used as the resistive coil 114*a* in an aspect of the present invention.

The heat pipe 115 is formed in a tube shape, and both ends of the pipe are sealed. A predetermined amount of a working fluid 116 is contained in the heat pipe 115. The working fluid 116 is vaporized by heat of the heater 114 and serves as a thermal medium which transfers the heat to the cylindrical roller 113, prevents a temperature deviation on the surface of the cylindrical roller 113, and heats the overall cylindrical roller 113 within a short time. The working fluid 116 has a volume ratio of 5–50% with respect to a volume of the heat pipe 115. Preferably, the working fluid 116 occupies 5–15% of the volume of the heat pipe 115. A volume ratio of the working fluid 116 less than 5% is not preferable because a dry out is highly likely to occur.

The working fluid 116 is selectively used depending on the material of the heat pipe 115. That is, when the material of the heat pipe 115 is made of stainless steel, most known fluids, excluding water, may be used as the working fluid 116.

If the material of the heat pipe 115 is copper (Cu), most known fluids may be used as the working fluid 116. Among these known fluids, water, i.e., distilled water, is the most preferable. When water or distilled water is used as the working fluid 116, costs for the working fluid 116 are reduced, and environmental contamination does not occur.

The temperature of the surface of the silicon rubber roller 112, which contacts the paper 150 onto which a toner image is transferred through the toner protective layer 111, should be maintained at about 175° C. However, the inner surface of the silicon rubber roller 112, which contacts the cylindrical roller 113, is maintained at 230–240° C. Thus, silicon that is heat resistant at a high temperature is used in the silicon rubber roller 112. The rubber roller 112 forms a fusing nip having a predetermined length, i.e., 6–7 mm, so as to aid fusing of the paper 150 which passes quickly in a high-speed laser printer. Also, the rubber roller 112 aids fusing of an overlapped toner image in a color laser printer.

The cylindrical roller 113 is heated by the heat of the heater 114 and by the vaporized heat generated from the working fluid 116 in the heat pipe 115. The heat of the cylindrical roller 113 is transferred to the rubber roller 112, and then fuses the toner 151, which is in a powder state formed on the paper 150. The cylindrical roller 113 is preferably formed of stainless steel, aluminum (Al), or copper (Cu).

First and second end caps 120 and 130 are inserted in both ends of the cylindrical roller 113. The structure of the second end cap 130 is substantially similar to the first end cap 120, the significant difference being that a gear 131 is formed along an outer surface of the second end cap 130. The gear on the outer surface of the second end cap 130 is engaged with a gear (not shown) of a motor (not shown), and is rotated by that motor's gear. Also, bearings 133 are installed at both ends of the fusing roller 110 to support the rotating fusing roller 110.

Figure 5A:
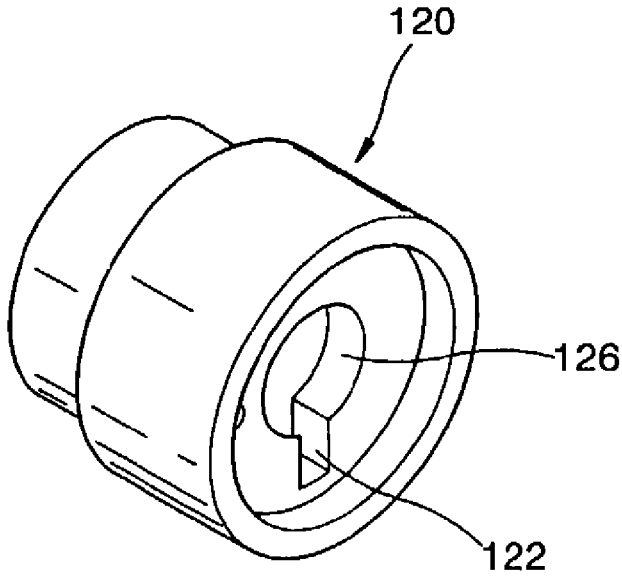
FIGS. 5A and 5B are perspective views of a first end cap of FIG. 3.
Figure 5B:
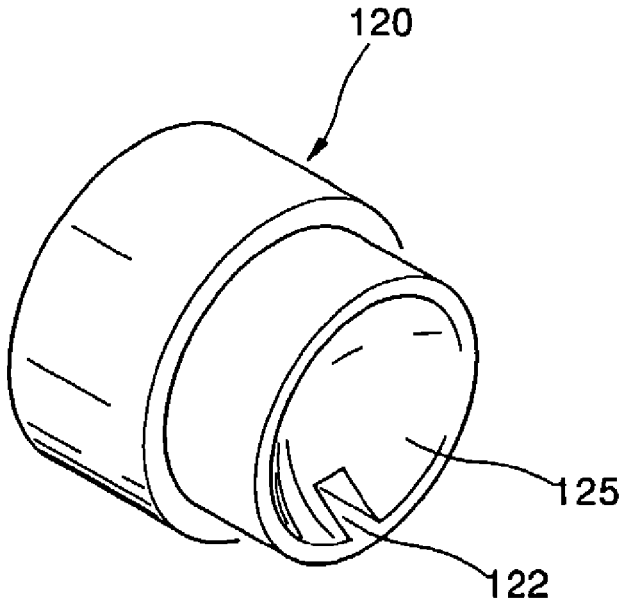
Figure 6A:
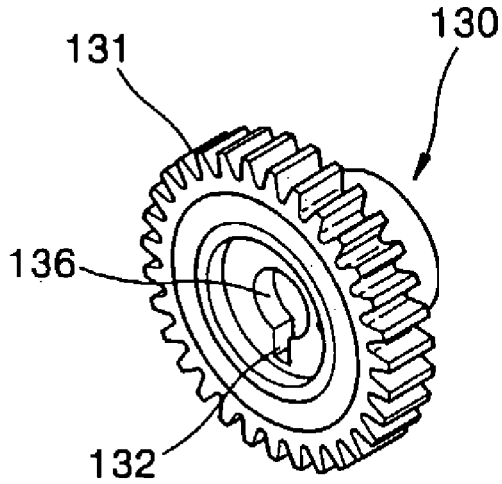
FIGS. 6A and 6B are perspective views of a second end cap of FIG. 3.
Figure 6B:
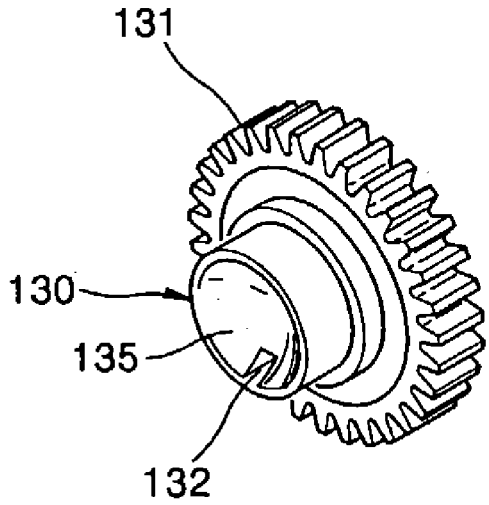

FIGS. 5A and 5B are perspective views of a first end cap 120 of FIG. 3, and FIGS. 6A and 6B are perspective views of a second end cap 130 of FIG. 3. Referring to FIGS. 5A through 6B, lead holes 122 and 132, through which a lead (117 of FIG. 3) is connected to an end of the resistive coil 114*a*, are formed in the first and second end caps 120 and 130, respectively. Concave parts 125 and 135, in which part of an end of the heat pipe 115 are positioned, are formed inside the first and second end caps 120 and 130 to face an end of the heat pipe 115. Electrode grooves 126 and 136, in which an electrode 210 is inserted, are formed in the center of the first and second end caps 120 and 130 opposite to the concave parts 125 and 135. The electrode 210 supplies an electricity to the lead 117 which passes through the lead holes 122 and 132.

Figure 7:
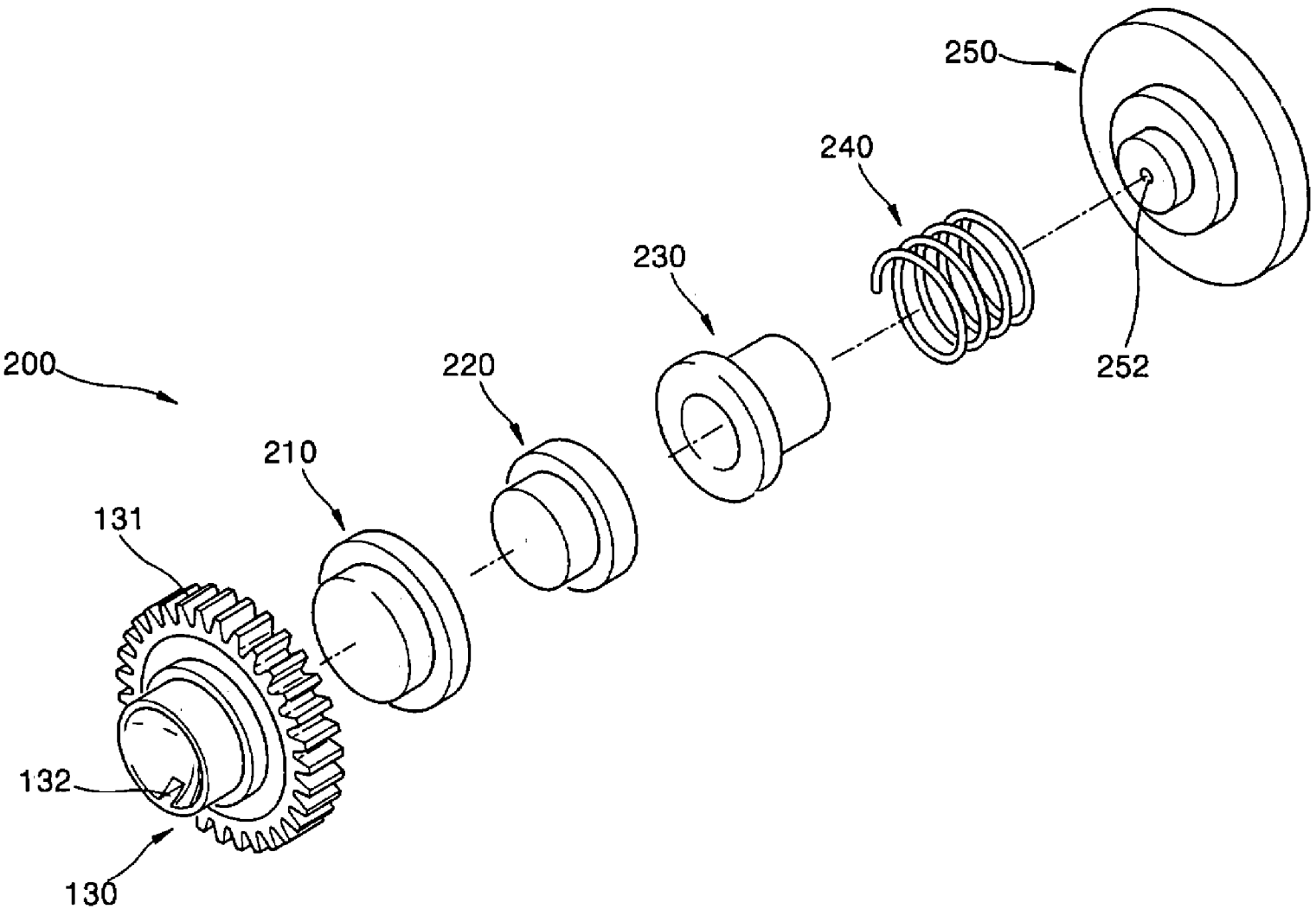
FIG. 7 is an exploded perspective view of a power connection unit of FIG. 3.

FIG. 7 is an exploded perspective view of a power connection unit 200 connected to the second end cap 130. Referring to FIG. 7, the power connection unit 200 is installed in a frame (170 of FIG. 3) and transfers an external power to the heater 114. The power connection unit 200 includes an electrode 210 inserted in the electrode grooves 126 and 136, a brush 220 which contacts the electrode 210, and an elastic element 240 which closely adheres the brush 220 to the electrode 210 for an electrical contact. The brush 220 is connected to a lead (254 of FIG. 3) supplied from an external power supply to transfer electricity to the electrode 210.

The elastic element 240 provides an elastic force to a spacer 230 so that the brush 220 is closely adhered to the electrode 210. Even though thermal expansion or thermal contraction repeatedly occurs while the fusing roller 110 is operated, the elastic element 240 absorbs the resulting deformation to prevent the brush 220 from being isolated from the electrode 210. Preferably, a compression spring is used as the elastic element 240. In this embodiment, a lead (254 of FIG. 3) from the external power supply is connected to the brush 220 through a lead hole 252. In this embodiment, the lead 254 and the elastic element 240 could make incidental contact, and sparks could occur. Thus, the spacer 230 is installed between the brush 220 and the elastic element 240, in order to prevent a spark and also to prevent the end cap 130 from contacting the frame 170 due to the drawn-back brush 220.

An end of the elastic element 240 is confined in the frame 170 by an insulating plate 250. The insulating plate 250 supports the elastic element 240. Thus, the brush 220 is first installed in a through hole formed in the frame 170. Then the spacer 230 and the elastic element 240 are installed in the through hole. Next, the insulating plate 250 is installed so that the elastic element 240 is not drawn back.

The first and second end caps 120 and 130 may be made of a resin, such as polyphenylene sulfide (PPS), in which a filler material such as glass fiber, having small thermal deformation even at a high temperature, is inserted. Poly butylene terephthalate (PBT) and nylon are other possible preferred materials for the first and second end caps 120 and 130.

The pressing roller 160 includes an elastic roller 161, which contacts the fusing roller 110 and forms a fusing nip therebetween, and a shaft 162 which supports the elastic roller 161. Bearings 163, disposed at the circumference of the end of the shaft 162, support the pressing roller 160.

The operation of the fusing device for an electrophotographic image forming apparatus having the above structure according to the present invention will be described in detail with reference to the accompanying drawings.

If electricity from the external lead 254 is connected to the lead 117 of the heater 114 through the brush 220 and the electrode 210, heat is generated at the resistive coil 114*a*. Part of the heat is transferred to the cylindrical roller 113, and the other part of the heat is transferred to the heat pipe 115. The working fluid 116 contained in the heat pipe 115 is heated by the heat and is vaporized, and the heat of the working fluid 116 in a gaseous state is transferred to the cylindrical roller 113 through the heater 114 installed on the surface of the heat pipe 115. The heat generated in the heater 114 and the heat from the working fluid 116 are transferred to the cylindrical roller 113 such that the temperature of the cylindrical roller 113 increases to about 230° C. The heat of the cylindrical roller 113 is transferred to the silicon rubber roller 112 such that the surface temperature of the fusing roller 110 reaches a target temperature required to fuse the toner 151, which is formed in a powder state, onto the paper 150 within a short time.

Subsequently, in a printing mode, the toner 151 is transferred in a powder state onto the paper 150, and the paper 150 passes between the fusing roller 110 and the pressing roller 160, and the toner 151 is fused onto the paper 150 by the fusing roller 110 maintained at a predetermined temperature.

Meanwhile, as the fusing roller 110 fuses the paper 150, the heat of the fusing roller 110 is taken to the paper 150, and the working fluid 116 inside the heat pipe 115 loses the heat and is liquefied. Then, the working fluid 116, to which heat is transferred by the heater 114, is vaporized such that the surface temperature of the fusing roller 110 is maintained at a target temperature suitable for fusing the toner 151 onto the paper 150.

In general, a fusing temperature of a toner image is about 160–190° C. The fusing device 100, according to the first embodiment of the present invention, reaches the target temperature within about 10 seconds. The thermistor 118 measures the surface temperature of the fusing roller 110 and a controller (not shown) maintains the surface temperature of the fusing roller 110 within a predetermined range suitable for fusing the toner 151 onto the paper 150. If adjustment of the surface temperature fails and the surface temperature of the fusing roller 110 rapidly increases, the thermostat 119 cuts off the power connection unit 200 connected to the thermostat 119 through a mechanical operation and prevents a rapid increase in the surface temperature of the fusing roller 110. This power supply operation may be varied according to a set temperature, and may be performed using various controlling methods such as periodic on/off, pulse width modulation (PWM), or proportional and integral (PI).

Figure 8:
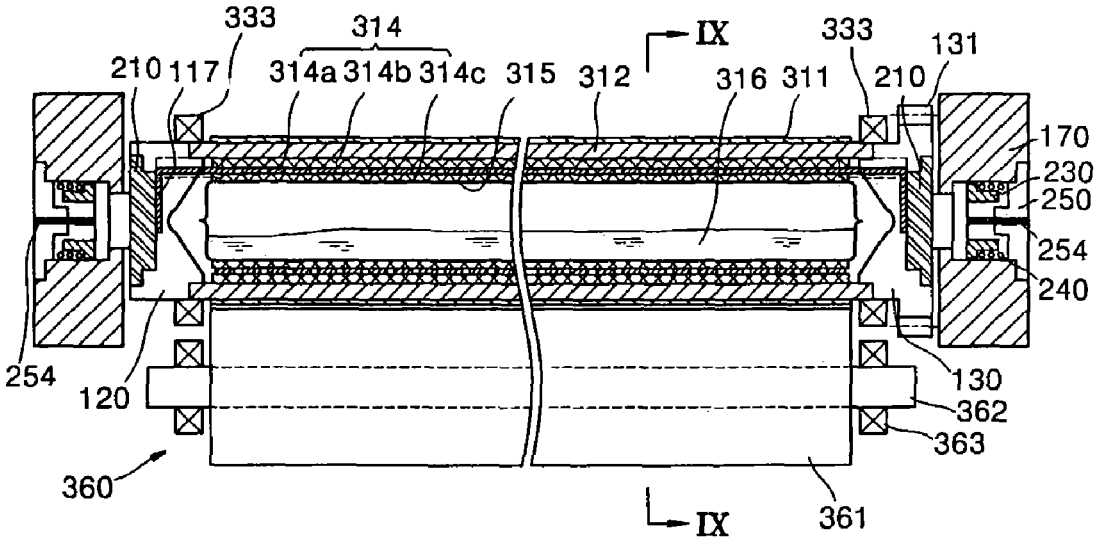
FIG. 8 is a schematic profile cross-sectional view of the fusing device for an electrophotographic image forming apparatus according to a second embodiment of the present invention.
Figure 9:
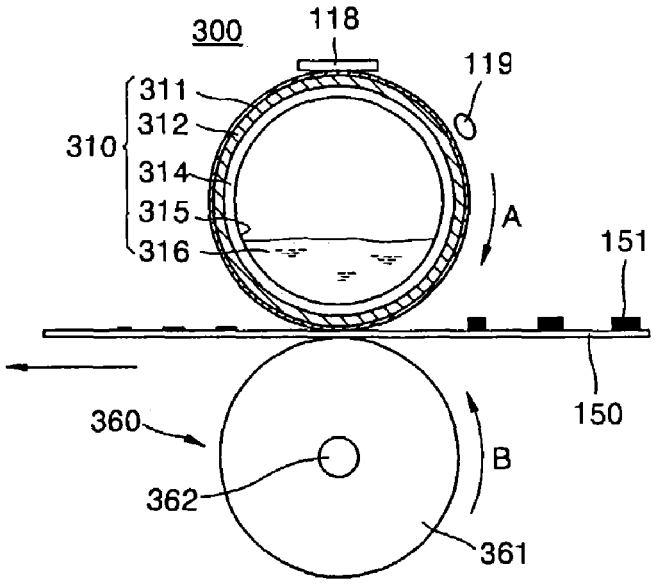
FIG. 9 is a cross-sectional view taken along line IX—IX of FIG. 8.

FIG. 8 is a schematic profile cross-sectional view of the fusing device for an electrophotographic image forming apparatus according to a second embodiment of the present invention, and FIG. 9 is a cross-sectional view taken along line IX—IX of FIG. 8. Like names and/or reference numerals are used to refer to like elements such as those of the first embodiment, and detailed descriptions thereof will be omitted.

Referring to FIGS. 8 and 9, a fusing device 300 includes a fusing roller 310 which rotates in a direction in which a sheet of print paper 150 having a toner image 151 thereon is ejected, i.e., in a direction indicated by arrow A, and a pressing roller 360 which is installed to face the fusing roller 310 through the paper 150 therebetween and rotates in a direction indicated by arrow B to be in contact with the fusing roller 310.

A toner protective layer 311, a silicon rubber roller 312, a heater 314, and a heat pipe 315 are sequentially arranged inwardly from the surface of the fusing roller 310, and a working fluid 316 is included in the heat pipe 315. It is characteristic of this embodiment that the fusing roller 310 does not include a cylindrical roller 113, as is included in the fusing roller 110 according to the first embodiment. In the fusing roller 310 having the rubber roller 312, the temperature at an inner surface of the rubber roller 312 should be 40–60° C. higher than the outer surface temperature of the rubber roller 312. Thus, in order to prevent an overheating of the rubber roller 312 due to a rapid temperature increase of the heater 314, the rate at which temperature rises through the heater 314 should be lowered.

Consequently, in the fusing roller 310 from which the cylindrical roller 113 is removed, heat generated in the heater 314 is directly transferred to the rubber roller 312, and thus a heat transfer speed is high. Thus, the temperature rising rate of the roller 312 can be increased.

The first and second end caps 120 and 130 are inserted in both ends of the rubber roller 312. The structure of the second end cap 130 is substantially similar to the first end cap 120, the significant difference being that a gear 131 is formed along an outer surface of the second end cap 130. The gear on the outer surface of the second end cap 130 is engaged with a gear (not shown) of a motor (not shown), and is rotated by that motor's gear. Also, bearings 333 are installed at both ends of the fusing roller 310 to support the rotating fusing roller 310.

The pressing roller 360 includes an elastic roller 361, which contacts the fusing roller 310 and forms a fusing nip therebetween, and a shaft 362 which supports the elastic roller 361. Bearings 363, disposed at the circumference of the end of the shaft 362, support the pressing roller 360. The pressing roller 360 is closely adhered to the fusing roller 310, or is placed to contact the fusing roller 310 by an additional spring (not shown) which presses the shaft 362 against the fusing roller 310. The pressing roller 360 is driven by a rotation of the fusing roller 310.

In order to manufacture the fusing roller 310 having the above structure, the heat pipe 315, a circumference of which is surrounded by the heater 314, is inserted inside the rubber roller 312, and then, a pressure of 100–150 bars is applied inside the heat pipe 315 to enlarge the heat pipe 315. Thus, the heater 314 is closely adhered between an outer surface of the heat pipe 315 and an inner surface of the rubber roller 312. In this embodiment, in order to prevent movement between the heater 314 and the rubber roller 312, a heat-resistant adhesive is coated on the surface of the heater 314 before the above-mentioned enlarging process is performed.

The warming-up time of the fusing device 310 according to the second embodiment of the present invention is faster, compared to the warming-up time of the fusing device 110 according to the first embodiment of the present invention.

As described above, in the fusing device for an electrophotographic image forming apparatus according to the present invention, a warming-up time required for an initial driving is shortened using a heat pipe. A fusing nip having a predetermined width is formed using a large-sized fusing roller having a diameter of 35–50 mm such that the fusing device can be effectively used in a color laser printer and a high-speed laser printer.

Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A fusing device for an electrophotographic image forming apparatus, the device comprising:

a fusing roller apparatus with a rubber fusing roller having a protective outer layer;

a heating pipe disposed in the center of the fusing roller apparatus;

a heating element disposed on the outer surface of the heating pipe; and a pressing roller which closely adheres paper passing between the pressing roller and the rubber fusing roller to the rubber fusing roller, wherein both ends of the heating pipe are sealed, and a predetermined amount of a working fluid is contained inside the heating pipe.

2. The device of claim 1, wherein the rubber fusing roller is of a predetermined thickness so as to form a fusing nip with the pressing roller, wherein the fusing nip is of a predetermined width.

3. The device of claim 2, wherein the rubber fusing roller is formed of silicon.

4. The device of claim 2, wherein the thickness of the rubber fusing roller is 1–3 mm.

5. The device of claim 2, wherein the outer diameter of the fusing roller apparatus is 35–50 mm.

6. The device of claim 1, wherein the rubber fusing roller and the heating element are adhered together using a heat-resistant adhesive coated between the rubber fusing roller and the heating element.

7. The device of claim 1, wherein the outer protective layer is Teflon.

8. A fusing device for an electrophotographic image forming apparatus, the device comprising:

a fusing roller having an outer rubber layer;

a heating pipe disposed in the center of the fusing roller;

a heating element disposed on the outer surface of the heating pipe is adhered to the rubber layer; and a pressing roller which closely adheres paper passing between the pressing roller and the fusing roller to the fusing roller, wherein both ends of the heating pipe are sealed, and a predetermined amount of a working fluid is contained inside the heating pipe.

* * * * *